US006543682B1

(12) United States Patent
Glaser

(10) Patent No.: US 6,543,682 B1
(45) Date of Patent: Apr. 8, 2003

(54) INSULIN-DOSE CALCULATOR DISK

(76) Inventor: Nichole Glaser, 937 Eucalyptus St., Davis, CA (US) 95616

( * ) Notice: Subject to any disclaimer, the term of this patent is extended or adjusted under 35 U.S.C. 154(b) by 0 days.

(21) Appl. No.: 09/564,302

(22) Filed: May 3, 2000

(51) Int. Cl.[7] ..... G06C 27/00
(52) U.S. Cl. ..... 235/66; 235/72
(58) Field of Search ..... 235/66, 72, 74, 235/78 R, 78 RC, 85 PC, 115, 116

(56) References Cited

U.S. PATENT DOCUMENTS

| | | | | | |
|---|---|---|---|---|---|
| 3,220,644 | A | | 11/1965 | Gaudio | |
| 3,358,920 | A | | 12/1967 | Ringley | |
| 3,471,084 | A | | 10/1969 | Titus | |
| 3,648,625 | A | | 3/1972 | Glass | |
| 4,001,551 | A | | 1/1977 | Hirsimaki | |
| 4,018,223 | A | | 4/1977 | Ethington | |
| 4,048,477 | A | * | 9/1977 | Hungerford | 235/78 R |
| 4,082,842 | A | | 4/1978 | Nahle | |
| 4,149,068 | A | | 4/1979 | Simon | |
| 4,308,450 | A | | 12/1981 | Ausman et al. | |
| 4,599,508 | A | * | 7/1986 | Smetaniuk | 235/116 |
| 4,797,539 | A | * | 1/1989 | Forest | 235/78 R |
| 4,882,472 | A | * | 11/1989 | Sigman et al. | 235/78 R |
| 5,025,785 | A | | 6/1991 | Weiss | |
| 5,216,597 | A | | 6/1993 | Beckers | |
| 5,251,126 | A | | 10/1993 | Kahn et al. | |
| 5,273,320 | A | | 12/1993 | deMaCarty | |
| 5,640,774 | A | * | 6/1997 | Goldman | 116/316 |
| 5,643,868 | A | | 7/1997 | Weiner et al. | |
| 5,763,396 | A | | 6/1998 | Weiner et al. | |
| 5,843,886 | A | | 12/1998 | Weiner et al. | |
| 5,858,968 | A | | 1/1999 | Weiner et al. | |
| 5,971,922 | A | | 10/1999 | Arita et al. | |
| 5,993,388 | A | | 11/1999 | Kattan et al. | |
| 5,997,475 | A | | 12/1999 | Bortz | |

* cited by examiner

*Primary Examiner*—Karl D. Frech
(74) *Attorney, Agent, or Firm*—Morrison & Foerster LLP

(57) ABSTRACT

This is a manual circular calculator for determining an appropriate insulin injection dosage to be taken with a meal. Preferably, the calculator has a pair of circular members which rotate around a single common center to allow calculation of the dosage. The front member includes a viewing panel showing an array of insulin injection dosage values that are printed on the rear circular member. The front member includes a series of measured blood glucose levels along a radius adjacent the viewing panel. The rear member typically has visible ingested carbohydrate values positioned along the outer perimeter of the member and, as noted above, a number of insulin injection dosage value arrays which become visible as one member is turned relative to the other. It is common that a physician would have a kit of these inventive devices, so that the appropriate one could be chosen depending on the insulin sensitivity, age, and size of the patient. In using the inventive calculator, a patient measures his or her blood glucose level and determines the weight of carbohydrates to be ingested at a particular meal. The carbohydrate ingestion is found on the outer perimeter of the back member of the device, the front member of the inventive device is turned so that an array of insulin values is visible, and the appropriate blood glucose level is read along the radius of the front circular member. The corresponding insulin injection dosage is seen in the window.

14 Claims, 2 Drawing Sheets

INSULIN-DOSE CALCULATOR DISK

FIELD OF THE INVENTION

This invention is a manual circular calculator for determining an appropriate insulin injection dosage to be taken with a meal. Preferably, the calculator has a pair of circular members which rotate around a single common center to allow calculation of the dosage. The front member includes a viewing panel showing an array of insulin injection dosage values which are printed on the rear circular member. The front member includes a series of measured blood glucose levels along a radius adjacent the viewing panel. The rear member typically has visible ingested carbohydrate values positioned along the outer perimeter of the member and, as noted above, a number of insulin injection dosage value arrays which become visible as one member is turned relative to the other. It is common that a physician would have a kit of these inventive devices, so that the appropriate one could be chosen depending on the insulin sensitivity, age, and size of the patient. In using the inventive calculator, a patient measures his or her blood glucose level and determines the weight of carbohydrates to be ingested at a particular meal. The carbohydrate ingestion is found on the outer periameter of the back member of the device, the front member of the inventive device is turned so that an array of insulin values is visible, and the appropriate blood glucose level is read along the radius of the front circular member. The corresponding insulin injection dosage is seen in the window.

BACKGROUND OF THE INVENTION

The American Diabetes Association reports that nearly six percent (6%) of the population in the United States, a group of about 16 million people, has diabetes. A significant number of these people do not know they have the disease. The Association further reports that diabetes is the seventh leading cause of death in the United States, contributing to nearly two hundred thousand deaths per year.

Diabetes is a chronic disease having no known cure. The complications of the disease include blindness, kidney disease, nerve disease, and heart disease, perhaps with stroke. Diabetes is said to be the leading cause of new cases of blindness in individuals between the ages of twenty and seventy-four. Perhaps twelve to twenty-four thousand people per year lose their sight because of diabetes. Diabetes is the leading cause of end-stage renal disease, accounting for nearly forty percent of new cases. Nearly sixty to seventy percent of those with diabetes have mild to severe forms of diabetic nerve damage which, in severe forms, can lead to lower limb amputations. People with diabetes are two-to-four times more likely to have heart disease and to suffer strokes.

Diabetes is a disease in which the body does not produce or properly use insulin, a hormone needed to convert sugar, starches, and the like into energy. Although the cause of diabetes is not completely understood, genetics, environmental factors, and viral causes have been partially identified.

There are two major types of Diabetes: Type I and Type II. Type I diabetes (formerly known as Juvenile Diabetes), is an autoimmune disease in which the body does not produce enough insulin and most often occurs in young adults and children. People with Type I diabetes must take daily insulin injections to stay alive.

Type II diabetes is a metabolic disorder resulting from the body's inability to make enough, or properly to use, insulin. Type II diabetes accounts for ninety to ninety-five percent of diabetes. In the United States, Type II diabetes is nearing epidemic proportions, principally due to the increased number of older Americans and a greater prevalence of obesity and a sedentary life style.

Insulin, in simple terms, is the hormone that unlocks the cells of the body, allowing glucose to enter those cells and to feed them. Since, in diabetics, glucose cannot enter the cells, the glucose builds up in the blood and the body's cells literally starve to death. Diabetics having Type I diabetes typically are required to self-administer insulin using, e.g., a syringe or a pen device with needle and cartridge. Continuous subcutaneous insulin infusion via implanted pumps is also available. Insulin typically is made chemically identical to human insulin by recombinant DNA technology. Although there are a variety of different insulins for rapid-, short-, intermediate-, and long-acting forms that may be used variously, separately or mixed in the same syringe, the use of insulin for treatment for diabetes is not to be ignored.

It is highly recommended by the medical profession that insulin-using patients practice self-monitoring of blood glucose (SMBG). Based upon the level of glucose in the blood, individuals may make insulin dosage adjustments before injection., Adjustments are necessary since blood glucose levels vary day-to-day for a variety of reasons, e.g., exercise, stress, rates of food consumption, types of food, hormonal changes (pregnancy, puberty, etc.) and the like. Despite the importance of SMBG, several studies have found that the proportion of individuals who self-monitor at least one a day significantly declines with age. This decrease is likely due simply to the fact that the typical, most widely used, method of smbg involves obtaining blood samples from a finger stick. Another difficulty is due to the various calculations surrounding the prospective administration of insulin taken a meal, where those calculations are based upon the concept of determining the amount of carbohydrate in a meal and, as an adjunct of the meal, subcutaneously injecting oneself with an insulin dose to counteract the prospective insulin deficiency.

Currently, "carbohydrate counting" is used in conjunction with a glucose level measurement to determine an appropriate insulin dosage to be taken with the meal. A physician provides the patient with a set of calculations or tables to allow self-determination of that insulin dosage. The calculations and tables are based on a wide variety of factors, including, e.g., body weight and sensitivity of the individual to insulin.

My invention is a simple, circular slide rule tailored for (or selected by the physician for) a specific patient depending upon the medical condition and physical makeup of the patient.

Other calculators have been used in the healthcare field. For instance, U.S. Pat. No. 4,308,450 shows a two-piece slide calculator for determining metabolic requirements and parenteral feeding dosages.

U.S. Pat. No. 4,149,068 shows a circular slide rule improvement which is said to be used in particular for use in X-ray dosage calculations.

A two-part linear slide rule has, on occasion, been provided by the Children's Hospital of Los Angeles to its patients for determination of insulin dosage.

None of the cited documents shows a circular calculator for the purpose of my invention nor does any have the information described herein.

Other circular calculators are used for a variety of reasons ranging from calculating the odds in horse races (U.S. Pat. No. 4,001,551, to Hirsimaki) to determining appropriate times for planting, growing, and harvesting of crops (U.S. Pat. No. 5,273,320, to deMaCarty).

SUMMARY OF THE INVENTION

This invention is a manual circular calculator for determining a specific insulin injection dosage to be taken with a meal. It is made up of a a first circular member having a center, a radius, and a viewing panel (pie-shaped or wedge-shaped) extending from the center. Preferably, a series of patient-measured blood glucose levels is found along a radius adjacent that viewing panel. The viewing panel may be an open window-like area or a transparent material such as a polymer. The calculator also includes a second circular member similarly having a center and a radius larger than the radius of the first circular member. A number of insulin injection dosage value arrays, each array having a number of insulin injection dosage values, are positioned on the second or back circular member in an area and position such that the values are visible in the viewing panel those values correspond to the measured blood glucose levels on adjacent the viewing panel. The displayed insulin injection dosage values further correspond to an ingested carbohydrate amount positioned on the exterior periphery of the first circular member.

The centers of the first circular member and the second circular member coincide. The two discs are rotatable about those centers with respect to each other and allow the display of an array of insulin injection dosage values in the viewing panel that both corresponds to an ingested carbohydrate amount and to measured blood glucose levels.

The insulin injection dosage value arrays may be selected from arrays found in the included Tables. The individual values generally are 0–40 units, but may be from 0–3 units.

Since this calculator is desirably used by children, it may be decorated with, e.g., a foodstuff, pictured thereon. However, the pictured foodstuff may corresponds to the insulin sensitivity of a patient and be used to distinguish one calculator from another calculator.

The invention includes sets of calculators wherein at least some of said calculators have differing arrays of insulin injection dosage value arrays, perhaps with values selected from the Tables included herein.

Finally, the invention includes a method of using the calculator for determining an insulin injection dosage to be taken with a meal using the invemtive manual circular calculator, comprising the steps of a.) aligning the first circular member by rotation with respect to the second circular member so that a chosen ingested carbohydrate amount (found on the back disc's periphery) is adjacent the viewing panel so that an insulin injection dosage value array is visible in that viewing panel, b.) selecting a measured blood glucose level from those found adjacent the viewing panel, and c.) determining a corresponding insulin injection dosage value adjacent the selected measured blood glucose level.

The inventive method further includes the step of selecting an appropriate variation of the inventive manual circular calculator for a patient, as would be done by a physician, desirably from the noted set.

DETAILED DESCRIPTION OF THE INVENTION

Figure 1:
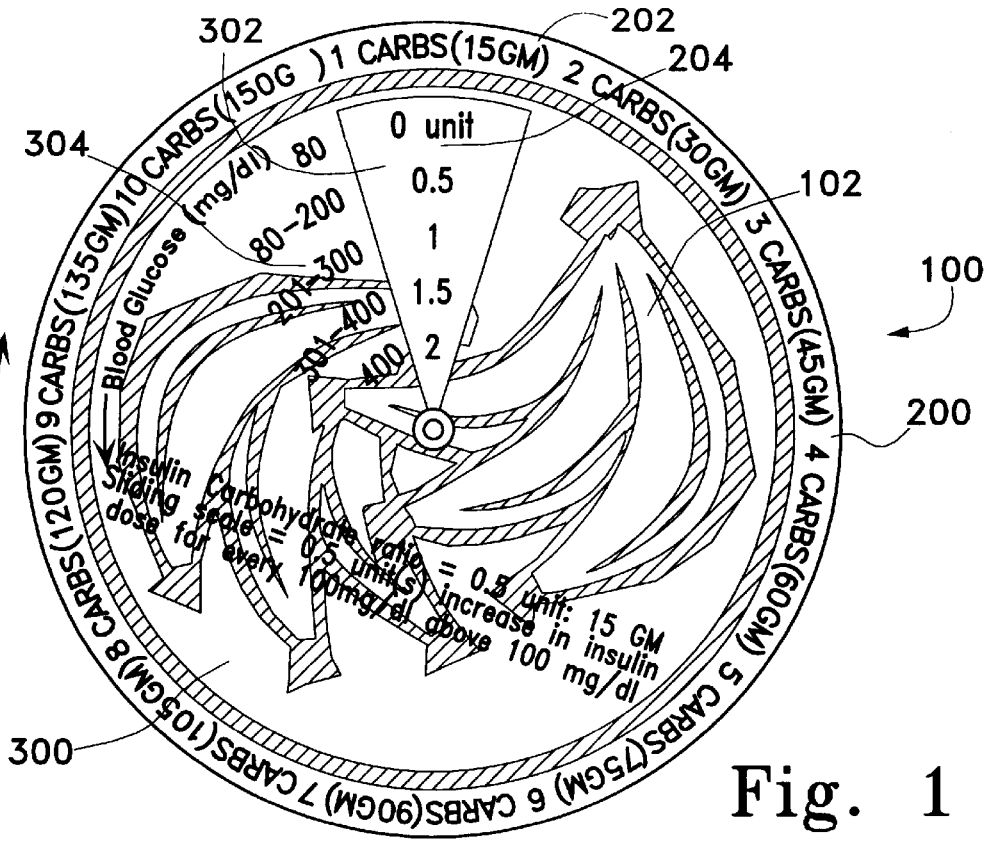
FIG. 1 shows one variation of the inventive device, assembled for use.

FIG. 1 shows the assembled device (100).

As noted above, the inventive calculator (100), here displayed with food depiction in the form of bananas, is made up of two generally circular members: the rear member (200) and the front member (300). A kit of these calculators—perhaps displaying the insulin doseage values shown in the various Tables below—may be supplied to a physician for their choice for a specific patient. Since insulin effectiveness varies with the physiology, body size and the like of the patient, different insulin doses are appropriate. In general, the differences in the Tables and hence, in the arrays of insulin dosage, are due to variations in the ratio between insulin dosage and carbohydrate ingestion.

In any event, the calculator's rear member (200) is rotated with respect to the front member (300) in such a way that a patient aligns an appropriate amount of carbohydrate (202) (on the rear member) with viewing panel (302) (on the front member) to display an array of insulin dosage values (204) within that panel (302). Depending on the predetermined blood glucose level (304) arrayed along a radius of front panel circular member (300), an appropriate insulin dose is chosen. It should be apparent that the radius of rear member (200) is larger than the radius of front member (300). In this way, the number of carbohydrates servings or weight of carbohydrate servings (202) is visible on the edge or periphery of rear member (200).

Generally, it is desirable that calculator (100) be color-keyed, or since the device is desirably used by children, keyed with foods such as the depicted bananas (102) so that the physician may easily select one calculator from the set supplied which is right for the patient.

Figure 2:
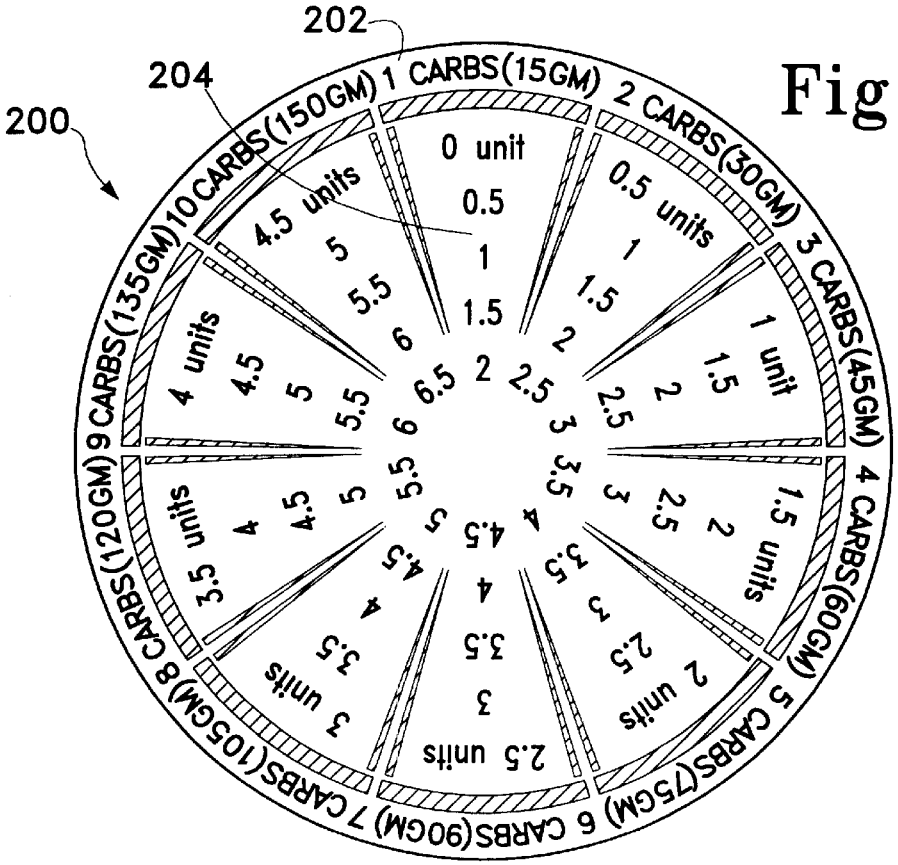
FIG. 2 shows the circular back (or "second") member of the inventive device and displays the chosen carbohydrate values on the periphery of that circular member and various arrays of insulin dosage values.

FIG. 2 shows the rear member (200). The various insulin injection dosage value arrays (204) found on rear member (200) correspond both to the carbohydrate ingestion indicia (202) on the outer periphery of rear member (204) and to the measured blood glucose levels extending along a radius of the viewing panel (302) (see FIG. 3).

Figure 3:
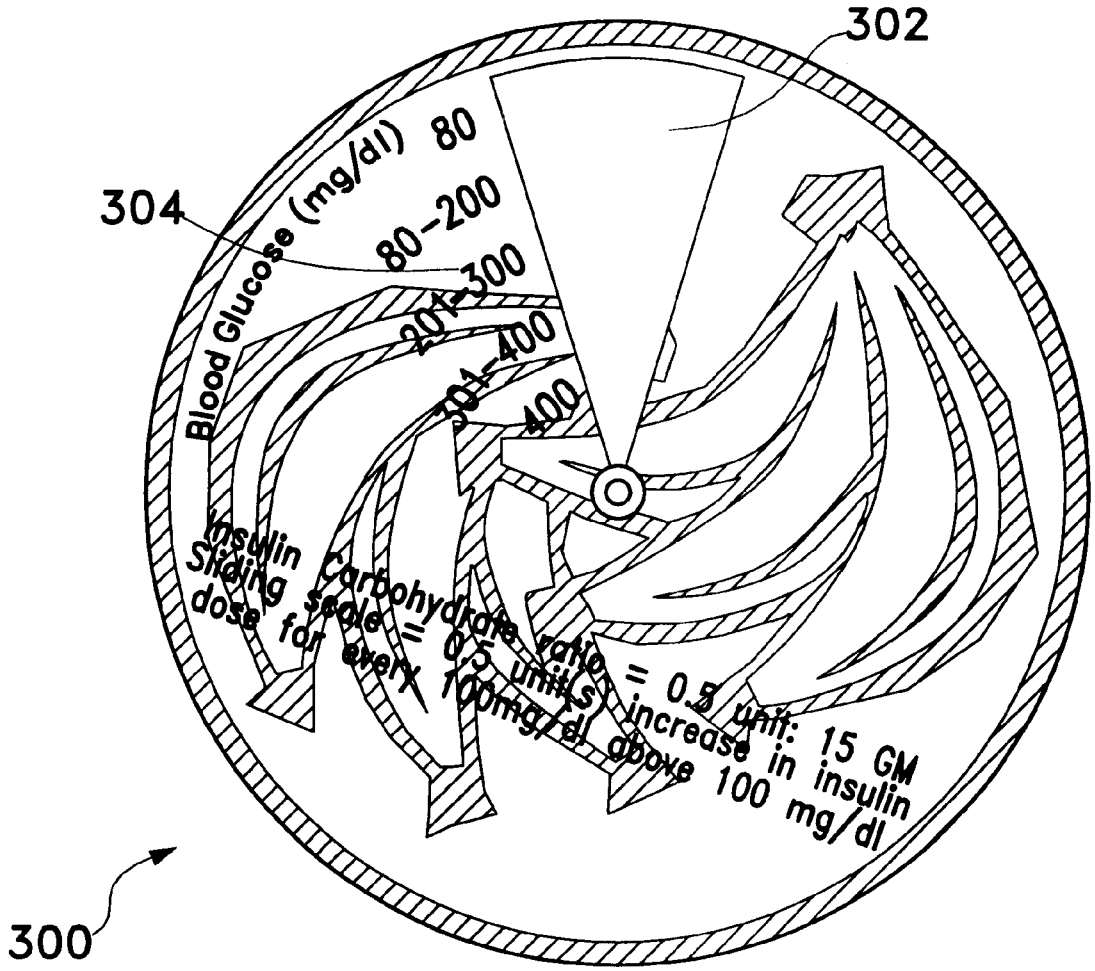
FIG. 3 shows the front (or "first") circular member with a wedge- or pie-shaped viewing window and listed blood glucose levels.

FIG. 3 shows the front member (300) with its viewing panel (302) and the listing of predetermined blood glucose levels (304) situated along a radius.

TABLES

Tables 1 through 15 below depict typical insulin dosages as a function of carbohydrate servings and measured blood glucose levels. For the purposes of explanation herein, an "array" is a sequence of values appearing vertically in a Table beneath a specific carbohydrate serving value. Each member of an array is a "insulin injection dosage value". These values may be portrayed, in whole or in part, on my circular calculator.

A physician would choose a different Table based upon the degree of insulin sensitivity of the patient. For instance, the insulin dosage values shown in Table 1 might be for a small child or someone who is very sensitive to diabetes. In contrast, Table 15 might be chosen for a patient who is fairly insulin-resistant.

TABLE 1

| Blood Glucose | Table of Insulin Dosage (Units) Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <80 | 0 | 0.5 | 1 | 1.5 | 2 | 2.5 | 3 | 3.5 | 4 | 4.5 |
| 80–200 | 0.5 | 1 | 1.5 | 2 | 2.5 | 3 | 3.5 | 4 | 4.5 | 5 |
| 201–300 | 1 | 1.5 | 2 | 2.5 | 3 | 3.5 | 4 | 4.5 | 5 | 5.5 |
| 301–400 | 1.5 | 2 | 2.5 | 3 | 3.5 | 4 | 4.5 | 5 | 5.5 | 6 |
| >400 | 2 | 2.5 | 3 | 3.5 | 4 | 4.5 | 5 | 5.5 | 6 | 6.5 |

(Insulin: Carbohydrate ratio = 0.5 units: 15 gms)

(Scale = 0.5 unit increase in insulin dose for every 100 mg/dL above 200 mg/dL)

TABLE 2

| Blood Glucose | Table of Insulin Dosage (Units) Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0 | 0 | 0.5 | 1 | 1.5 | 2 | 2.5 | 3 | 3.5 | 4 |
| 70–150 | 0.5 | 1 | 1.5 | 2 | 2.5 | 3 | 3.5 | 4 | 4.5 | 5 |
| 151–200 | 1.5 | 2 | 2.5 | 3 | 3.5 | 4 | 4.5 | 5 | 5.5 | 6 |
| 201–250 | 2.5 | 3 | 3.5 | 4 | 4.5 | 5 | 5.5 | 6 | 6.5 | 7 |
| 251–300 | 3.5 | 4 | 4.5 | 5 | 5.5 | 6 | 6.5 | 7 | 7.5 | 8 |
| 301–350 | 4.5 | 5 | 5.5 | 6 | 6.5 | 7 | 7.5 | 8 | 8.5 | 9 |
| >350 | 5.5 | 6 | 6.5 | 7 | 7.5 | 8 | 8.5 | 9 | 9.5 | 10 |

(Insulin: Carbohydrate ratio = 0.5 units: 15 gms)
(Scale = 1 unit increase in insulin dose for every 50 mg/dL above 150 mg/dL)

TABLE 3

| Blood Glucose | Table of Insulin Dosage (Units) Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <100 | 0.5 | 1.5 | 2.5 | 3.5 | 4.5 | 5.5 | 6.5 | 7.5 | 8.5 | 9.5 |
| 100–200 | 1 | 2 | 3 | 4 | 5 | 6 | 7 | 8 | 9 | 10 |
| 201–300 | 1.5 | 2.5 | 3.5 | 4.5 | 5.5 | 6.5 | 7.5 | 8.5 | 9.5 | 10.5 |
| 301–400 | 2 | 3 | 4 | 5 | 6 | 7 | 8 | 9 | 10 | 11 |
| >400 | 2.5 | 3.5 | 4.5 | 5.5 | 6.5 | 7.5 | 8.5 | 9.5 | 10.5 | 11.5 |

(Insulin: Carbohydrate ratio = 1 unit: 15 gms)

(Scale = 0.5 units increase in insulin dose for every 100 mg/dL above 200 mg/dL)

TABLE 4

| Blood Glucose | Table of Insulin Dosage (Units) Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0 | 1 | 2 | 3 | 4 | 5 | 6 | 7 | 8 | 9 |
| 70–150 | 1 | 2 | 3 | 4 | 5 | 6 | 7 | 8 | 9 | 10 |
| 151–200 | 2 | 3 | 4 | 5 | 6 | 7 | 8 | 9 | 10 | 11 |
| 201–250 | 3 | 4 | 5 | 6 | 7 | 8 | 9 | 10 | 11 | 12 |
| 251–300 | 4 | 5 | 6 | 7 | 8 | 9 | 10 | 11 | 12 | 13 |
| 301–350 | 5 | 6 | 7 | 8 | 9 | 10 | 11 | 12 | 13 | 14 |
| >350 | 6 | 7 | 8 | 9 | 10 | 11 | 12 | 13 | 14 | 15 |

(Insulin: Carbohydrate ratio = 1 unit: 15 gms)

(Scale = 1 unit increase in insulin dose for every 50 mg/dL above 150 mg/dL)

TABLE 5

| Blood Glucose | Table of Insulin Dosage (Units) Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0 | 0.5 | 1.5 | 2.5 | 3.5 | 4.5 | 5.5 | 6.5 | 7.5 | 8.5 |
| 70–150 | 1 | 2 | 3 | 4 | 5 | 6 | 7 | 8 | 9 | 10 |
| 151–200 | 2.5 | 3.5 | 4.5 | 5.5 | 6.5 | 7.5 | 8.5 | 9.5 | 10.5 | 11.5 |
| 201–250 | 4 | 5 | 6 | 7 | 8 | 9 | 10 | 11 | 12 | 13 |
| 251–300 | 5.5 | 6.5 | 7.5 | 8.5 | 9.5 | 10.5 | 11.5 | 12.5 | 13.5 | 14.5 |
| 301–350 | 7 | 8 | 9 | 10 | 11 | 12 | 13 | 14 | 15 | 16 |
| >350 | 8.5 | 9.5 | 10.5 | 11.5 | 12.5 | 13.5 | 14.5 | 15.5 | 16.5 | 17.5 |

(Insulin: Carbohydrate ratio = 1 unit: 15 gms)

(Scale = 1.5 units increase in insulin dose for every 50 mg/dL above 150 mg/dL)

TABLE 6

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0.5 | 2 | 3.5 | 5 | 6.5 | 8 | 9.5 | 11 | 12.5 | 14 |
| 70–150 | 1.5 | 3 | 4.5 | 6 | 7.5 | 9 | 10.5 | 12 | 13.5 | 15 |
| 151–200 | 2.5 | 4 | 5.5 | 7 | 8.5 | 10 | 11.5 | 13 | 14.5 | 16 |
| 201–250 | 3.5 | 5 | 6.5 | 8 | 9.5 | 11 | 12.5 | 14 | 15.5 | 17 |
| 251–300 | 4.5 | 6 | 7.5 | 9 | 10.5 | 12 | 13.5 | 15 | 16.5 | 18 |
| 301–350 | 5.5 | 7 | 8.5 | 10 | 11.5 | 13 | 14.5 | 15 | 17.5 | 19 |
| >350 | 6.5 | 8 | 9.5 | 11 | 12.5 | 14 | 15.5 | 17 | 18.5 | 20 |

(Insulin: Carbohydrate ratio = 1.5 units: 15 gms)
(Scale = 1 unit increase in insulin dose for every 50 mg/dL above 150 mg/dL)

TABLE 7

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0 | 1.5 | 3 | 4.5 | 6 | 7.5 | 9 | 10.5 | 12 | 13.5 |
| 70–150 | 1.5 | 3 | 4.5 | 6 | 7.5 | 9 | 10.5 | 12 | 13.5 | 15 |
| 151–200 | 3 | 4.5 | 6 | 7.5 | 9 | 10.5 | 12 | 13.5 | 15 | 16.5 |
| 201–250 | 4.5 | 6 | 7.5 | 9 | 10.5 | 12 | 13.5 | 15 | 16.5 | 18 |
| 251–300 | 6 | 7.5 | 9 | 10.5 | 12 | 13.5 | 15 | 16.5 | 18 | 19.5 |
| 301–350 | 7.5 | 9 | 10.5 | 12 | 13.5 | 15 | 16.5 | 18 | 19.5 | 21 |
| >350 | 9 | 10.5 | 12 | 13.5 | 15 | 16.5 | 18 | 19.5 | 21 | 22.5 |

(Insulin: Carbohydrate ratio = 1.5 units: 15 gms)
(Scale = 1.5 units increase in insulin dose for every 50 mg/dL above 150 mg/dL)

TABLE 8

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0 | 1 | 2.5 | 4 | 5.5 | 7 | 8.5 | 10 | 11.5 | 13 |
| 70–150 | 1.5 | 3 | 4.5 | 6 | 7.5 | 9 | 10.5 | 12 | 13.5 | 15 |
| 151–200 | 3.5 | 5 | 6.5 | 8 | 9.5 | 11 | 12.5 | 14 | 15.5 | 17 |
| 201–250 | 5.5 | 7 | 8.5 | 10 | 11.5 | 13 | 14.5 | 16 | 17.5 | 19 |
| 251–300 | 7.5 | 9 | 10.5 | 12 | 13.5 | 15 | 16.5 | 18 | 19.5 | 21 |
| 301–350 | 9.5 | 11 | 12.5 | 14 | 15.5 | 17 | 18.5 | 20 | 21.5 | 23 |
| >350 | 11.5 | 13 | 14.5 | 16 | 17.5 | 19 | 20.5 | 22 | 23.5 | 25 |

(Insulin: Carbohydrate ratio = 1.5 units: 15 gms)
(Scale = 2 units increase in insulin dose for every 50 mg/dL above 150 mg/dL)

TABLE 9

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 1 | 3 | 5 | 7 | 9 | 11 | 13 | 15 | 17 | 19 |
| 70–150 | 2 | 4 | 6 | 8 | 10 | 12 | 14 | 16 | 18 | 20 |
| 151–200 | 3 | 5 | 7 | 9 | 11 | 13 | 15 | 17 | 19 | 21 |
| 201–250 | 4 | 6 | 8 | 10 | 12 | 14 | 16 | 18 | 20 | 22 |

TABLE 9-continued

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| 251–300 | 5 | 7 | 9 | 11 | 13 | 15 | 17 | 19 | 21 | 23 |
| 301–350 | 6 | 8 | 10 | 12 | 14 | 16 | 18 | 20 | 22 | 24 |
| >350 | 7 | 9 | 11 | 13 | 15 | 17 | 19 | 21 | 23 | 25 |

(Insulin: Carbohydrate ratio = 2 units/15 gms)
(Scale = 1 unit increase in insulin dose for every 50 mg/dL above 150 mg/dL)

TABLE 10

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0.5 | 2.5 | 4.5 | 6.5 | 8.5 | 10.5 | 12.5 | 14.5 | 16.5 | 18.5 |
| 70–150 | 2 | 4 | 6 | 8 | 10 | 12 | 14 | 16 | 18 | 20 |
| 151–200 | 3.5 | 5.5 | 7.5 | 9.5 | 11.5 | 13.5 | 15.5 | 17.5 | 19.5 | 21.5 |
| 201–250 | 5 | 7 | 9 | 11 | 13 | 15 | 17 | 19 | 21 | 23 |
| 251–300 | 6.5 | 8.5 | 10.5 | 12.5 | 14.5 | 16.5 | 18.5 | 20.5 | 22.5 | 24.5 |
| 301–350 | 8 | 10 | 12 | 14 | 16 | 18 | 20 | 22 | 24 | 26 |
| >350 | 9.5 | 11.5 | 13.5 | 15.5 | 17.5 | 19.5 | 21.5 | 23.5 | 25.5 | 27.5 |

(Insulin: Carbohydrate ratio = 2 units: 15 gms)
(Scale = 1.5 units increase in insulin dose for every 50 mg/dL above 150 mg/dL)

TABLE 11

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0.5 | 3 | 5.5 | 8 | 10.5 | 13 | 15.5 | 18 | 20.5 | 23 |
| 70–150 | 2.5 | 5 | 7.5 | 10 | 12.5 | 12 | 17.5 | 20 | 22.5 | 25 |
| 151–200 | 4.5 | 7 | 9.5 | 12 | 14.5 | 14 | 19.5 | 22 | 24.5 | 27 |
| 201–250 | 6.5 | 9 | 11.5 | 14 | 16.5 | 16 | 21.5 | 24 | 26.5 | 29 |
| 251–300 | 8.5 | 11 | 13.5 | 16 | 18.5 | 18 | 23.5 | 26 | 28.5 | 31 |
| 301–350 | 10.5 | 13 | 15.5 | 18 | 20.5 | 20 | 25.5 | 28 | 30.5 | 33 |
| >350 | 12.5 | 15 | 17.5 | 20 | 22.5 | 22 | 27.5 | 30 | 32.5 | 35 |

(Insulin: Carbohydrate ratio = 2 units/15 gms)
(Scale = 2 units increase in insulin dose for every 50 mg/dL above 150 mg/dL)

TABLE 12

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 1 | 3.5 | 5 | 8.5 | 11 | 13.5 | 16 | 18.5 | 21 | 23.5 |
| 70–150 | 2.5 | 5 | 7.5 | 10 | 12.5 | 15 | 17.5 | 20 | 22.5 | 25 |
| 151–200 | 4 | 6.5 | 9 | 11.5 | 14 | 16.5 | 19 | 21.5 | 24 | 26.5 |
| 201–250 | 5.5 | 8 | 10.5 | 13 | 15.5 | 18 | 20.5 | 23 | 25.5 | 28 |
| 251–300 | 7 | 9.5 | 12 | 14.5 | 17 | 19.5 | 22 | 24.5 | 27 | 29.5 |
| 301–350 | 8.5 | 11 | 13.5 | 16 | 18.5 | 21 | 23.5 | 26 | 28.5 | 31 |
| >350 | 10 | 12.5 | 15 | 17.5 | 20 | 22.5 | 25 | 27.5 | 30 | 32.5 |

(Insulin: Carbohydrate ratio = 2.5 units/15 gms)
(Scale = 1.5 units increase in insulin dose for every 50 mg/dL above 150 mg/dL)

TABLE 13

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 0 | 2 | 4 | 6 | 8 | 10 | 12 | 14 | 16 | 18 |
| 70–150 | 0 | 2 | 4 | 6 | 8 | 10 | 12 | 14 | 16 | 18 |
| 151–200 | 2 | 4 | 6 | 8 | 10 | 12 | 14 | 16 | 18 | 20 |

TABLE 13-continued

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| 201–250 | 4 | 6 | 8 | 10 | 12 | 14 | 16 | 18 | 20 | 22 |
| 251–300 | 6 | 8 | 10 | 12 | 14 | 16 | 18 | 20 | 22 | 24 |
| 301–350 | 8 | 10 | 12 | 14 | 16 | 18 | 20 | 22 | 24 | 26 |
| >350 | 10 | 12 | 14 | 16 | 18 | 20 | 22 | 24 | 26 | 28 |

(Insulin: Carbohydrate ratio = 2.5 units: 15 gms)
(Scale = 2 units increase in insulin dose for every 50 mg/dL above 150 mg/dL)

TABLE 14

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 1.5 | 4.5 | 7.5 | 10.5 | 13.5 | 16.5 | 19.5 | 22.5 | 25.5 | 28.5 |
| 70–150 | 3 | 6 | 9 | 12 | 15 | 18 | 21 | 24 | 27 | 30 |
| 151–200 | 4.5 | 7.5 | 10.5 | 13.5 | 16.5 | 19.5 | 22.5 | 25.5 | 28.5 | 31.5 |
| 201–250 | 6 | 9 | 12 | 15 | 18 | 21 | 24 | 27 | 30 | 33 |
| 251–300 | 7.5 | 10.5 | 13.5 | 16.5 | 19.5 | 22.5 | 25.5 | 28.5 | 31.5 | 34.5 |
| 301–350 | 9 | 12 | 15 | 18 | 21 | 24 | 27 | 30 | 33 | 36 |
| >350 | 10.5 | 13.5 | 16.5 | 19.5 | 22.5 | 25.5 | 28.5 | 31.5 | 34.5 | 37.5 |

(Insulin: Carbohydrate ratio = 3 units/15 gms)
(Scale = 1.5 units increase in insulin dose for every 50 mg/dL above 150 mg/dL)

TABLE 15

Table of Insulin Dosage (Units)

| Blood Glucose | Carbohydrate Servings (15 gm/serving) | | | | | | | | | |
|---|---|---|---|---|---|---|---|---|---|---|
| (mg/dL) | 1 | 2 | 3 | 4 | 5 | 6 | 7 | 8 | 9 | 10 |
| <70 | 1 | 4 | 7 | 10 | 13 | 16 | 19 | 22 | 25 | 28 |
| 70–150 | 3 | 6 | 9 | 12 | 15 | 18 | 21 | 24 | 27 | 30 |
| 151–200 | 5 | 8 | 11 | 14 | 17 | 20 | 23 | 26 | 29 | 32 |
| 201–250 | 7 | 10 | 13 | 16 | 19 | 22 | 25 | 28 | 31 | 34 |
| 251–300 | 9 | 12 | 15 | 18 | 21 | 24 | 27 | 30 | 33 | 36 |
| 301–350 | 11 | 14 | 17 | 20 | 23 | 26 | 29 | 32 | 35 | 38 |
| >350 | 13 | 16 | 19 | 22 | 25 | 28 | 31 | 34 | 37 | 40 |

(Insulin: Carbohydrate ratio = 3 units/15 gms)
(Scale = 2 units increase in insulin dose for every 50 mg/dL above 150 mg/dL)

I claim as my invention:

1. A manual circular calculator for determining an appropriate insulin injection dosage to be taken with a meal, comprising a.) a first circular member having a center, a radius, and a viewing panel extending from said center, measured blood glucose levels along a radius adjacent the viewing panel, and b.) a second circular member having a center, a radius larger than the radius of the first circular member radius, a multiplicity of insulin injection dosage value arrays, each array containing a number of insulin injection dosage values displayable in an area visible in said viewing panel and said displayable insulin injection dosage values corresponding to said measured blood glucose levels positioned adjacent the viewing panel, and wherein each insulin injection dosage value array further corresponds to an ingested carbohydrate amount positioned exterior to the first circular member, wherein said first circular member center and said second circular member center generally coincide and said members are rotatable about said centers with respect to each other to display an array of insulin injection dosage values in said viewing panel corresponding to an ingested carbohydrate amount and measured blood glucose levels as said members are rotated with respect to each other.

2. The calculator of claim 1 wherein said multiplicity of insulin injection dosage value arrays are selected from the group consisting of the set of arrays provided by each of Tables 1–15.

3. The calculator of claim 1 wherein said insulin injection dosage values have values from 0–40 units.

4. The calculator of claim 3 wherein said insulin injection dosage values have values from 0–3 units.

5. The calculator of claim 1 wherein said viewing panel is wedge-shaped.

6. The calculator of claim 5 wherein said viewing panel is open.

7. The calculator of claim 5 wherein said viewing panel is a transparent material.

8. The calculator of claim 1 wherein said first circular member has a front surface having foodstuffs pictured thereon.

9. The calculator of claim 8 wherein said pictured food corresponds to the insulin sensitivity of a patient.

10. A set of the calculators of claim 1 wherein at least some of said calculators have differing arrays of insulin injection dosage value arrays.

11. The set of the calculators of claim 10 wherein at least some of said differing arrays of insulin injection dosage value arrays are selected from the group consisting of the set of arrays provided by each of Tables 1–15.

12. A method for determining an insulin injection dosage to be taken with a meal using the calculator of claim 1, comprising the steps of:

a.) aligning the first circular member by rotation with respect to the second circular member such that a chosen ingested carbohydrate amount positioned exterior to the first circular member is positioned to display an insulin injection dosage value array in said viewing panel, b.) selecting a measured blood glucose levels from along a radius adjacent the viewing panel, and c.) determining a corresponding insulin injection dosage value adjacent said selected measured blood glucose level.

13. The method of claim 12 further comprising the step of selecting the calculator of claim 1 from the set of claim 10.

14. The method of claim 12 further comprising the step of selecting the calculator of claim 1 from the set of claim 11.

* * * * *